United States Patent [19]

Kaminaka et al.

[11] Patent Number: 4,937,562

[45] Date of Patent: Jun. 26, 1990

[54] MOXTURE-PROOF IONIZATION SMOKE DETECTOR

[75] Inventors: Yoshinori Kaminaka, Sagamihara; Hiroshi Yashima, Shibata, both of Japan

[73] Assignee: Hochiki Corp., Tokyo, Japan

[21] Appl. No.: 283,241

[22] Filed: Dec. 9, 1988

[30] Foreign Application Priority Data

Dec. 26, 1987 [JP] Japan ..... 62-330545
Jan. 29, 1988 [JP] Japan ..... 63-10896

[51] Int. Cl.[5] ..... G08B 17/10
[52] U.S. Cl. ..... 340/163; 340/628
[58] Field of Search ..... 340/693, 629, 628, 630

[56] References Cited

U.S. PATENT DOCUMENTS 4,037,206 7/1977 Dobrzanski et al. ..... 340/693
4,724,430 2/1988 Igarashi ..... 340/693

*Primary Examiner*—Glen R. Swann, III
*Attorney, Agent, or Firm*—Lackenbach Siegel Marzullo & Aronson

[57] ABSTRACT

An ionization smoke detector of the present invention has an annular engaging flange portion formed integrally on the periphery of an insulating board and an engaging groove formed on a cover, so that a circuitry-accommodating portion may be moisture- and gas-tightly sealed merely by inserting the flange portion into the groove, without using special sealing members such as ruber packing members.

In an intermediate electrode mounting structure of the present invention, support legs are formed integrally on the periphery of the intermediate electrode which may be simply inserted into an opening of the insulating board to fix and support the intermediate electrode, without using screws etc. Thus, a space needed to mount the intermediate electrode can be minimized. An electrode lead is connected to a lead of an FET insulatedly potted at an appropriate place on the backside of the insulating board with a hot melt synthetic resin. This can prevent possible penetration of moisture or corrosive gases into the circuitry-accommodating portion by the insulation sealing of the FET, even though the electrode lead passes through an opening of the insulating board. Thus, corrosion of the circuit parts can surely be avoided.

7 Claims, 8 Drawing Sheets

MOISTURE-PROOF IONIZATION SMOKE DETECTOR

BACKGROUND OF THE INVENTION

1. Field of the Invention

This invention relates to an ionization smoke detector having a characteristic moisture-proof structure for preventing penetration of moisture etc. into a circuitry-accomodating portion and having a characteristic structure for mounting electrodes on an insulating board within a detector cover.

2. Prior Art

As conventional ionization smoke detectors, there may be mentioned, for example, a smoke detector as illustrated in FIG. 16.

In FIG. 16, 50 is a detector body, 51 is a body cover and 52 is an outer cover. The outer cover 52 has smoke inlets 53.

An insulating board 54 is disposed in the detector body 50 comprising the body cover 51 and the outer cover 52. An inner electrode 56 with a radiation source 55, an intermediate electrode 58 with a transmitting aperture 57 and an outer electrode 59 into which external smoke may enter are supported and fixed on a foreside of the insulating board 54. These electrodes constitutes an electrode arrangement for ionization smoke detection. A printed circuit board 60 with detector circuitry packaged thereon is placed on a backside of the insulating board 54.

A space for accommodating the printed circuit board 60 is sealed, at its lower portion, with the insulating board 54 through a rubber packing 61 and, at its upper portion, with an upper lid 63 through a rubber packing 62, to prevent penetration of moisture or corrosive gases.

However, the number of parts to be employed is large and the manufacturing process is complicated in the conventional ionization smoke detector as described above, because the rubber packings 61, 62 are used for moisture preventing structure of the circuitry accommodating portion. In addition, the rubber packings 61, 62 increase a height of the detector, which makes it difficult to reduce the size of the detector.

In the conventional ionization smoke detector, an intermediate electrode 58 is mounted by screws on the insulating board 54 through a spacer 64 for forming an inner ionization chamber between the intermediate electrode 58 and the inner electrode 56.

In such an arrangement, a space is needed to fix the intermediate electrode 58 to the insulating board 54 by screws. This increases the space for mounting the intermediate electrode 58 and makes the assembling operation complicated because it needs screw fastening operation.

Furthermore, the conventional ionization smoke detector has such a disadvantage that an electrode lead of the intermediate electrode 58 extends through the insulating board 54 to be connected to a lead of an FET on the backside of the insulating board 54. This allows moisture or corrosive gases to enter the circuitry-accommodating space through the opening of the board through which the lead extends. This will possibly corrode the circuit parts.

SUMMARY OF THE INVENTION

The present invention has been made to overcome the problems involved in the conventional techniques and it is an object of the present invention to provide a moisture-tight structure for an ionization smoke detector which is capable of assuring moisture resistance for a circuitry-accommodating portion with a simple structure and attaining a smaller sized detector.

To attain the object as described above, the present invention features an ionization smoke detector including an insulating board provided within a cover and a circuit board disposed on a backside of the insulating board, said insulating board having an intermediate electrode with a radiation source, an intermediate electrode formed with an opening for transmitting radiation from said radiation source, and an outer electrode formed with smoke inlets on its side wall which are all mounted on said insulating board: said insulating board having an annular engaging flange portion formed integrally on a periphery of the insulating board, and said cover having an engaging groove into which said engaging flange is inserted; said engaging flange having a tip end extending towards the backside of the insulating board and directed outwardly; and said engaging groove having an outer inside wall inclined so that the engaging flange inserted in the groove presses against the wall.

With this arrangement, the annular engaging flange portion formed integrally with the insulating board may simply be inserted into the engaging groove of the cover to moisture-tightly sealing the circuitry accommodating portion formed on the backside of the insulating board. Thus, separate sealing members such as rubber packings etc. may be omitted, reducing the number of the parts and the number of assembling steps. In addition, the height of the circuit-accommodating portion may be reduced by a height of the packing members. This will enable the entire smoke detector to be small-sized.

It is another object of the present invention to provide an intermediate electrode mounting structure for an ionization smoke detector which is capable of easily mounting the intermediate electrode and capable of protecting circuit parts, allowing an electrode lead to extend through the insulating board to the circuit-accommodating portion.

To attain the object as mentioned above, the present invention features an ionization smoke detector including an insulating board provided within a cover and a circuit board disposed on a backside of the insulating board, said insulating board having an intermediate electrode with a radiation source, an intermediate electrode formed with an opening for transmitting radiation from said radiation source, and an outer electrode formed with smoke inlets on its side wall which are all mounted on said insulating board: said intermediate electrode having a plurality of support legs and at least one electrode lead formed integrally therewith; said electrode lead being inserted into a slit from a foreside of the insulating board and connected to a lead of an FET incorporated and insulatedly sealed on a backside of the insulating board; and said support legs each having serrated edges and inserted to be fixed in holes opened on the foreside of the insulating board but not through.

With this arrangement, the intermediate electrode can be mounted easily by merely inserting the support legs formed on the periphery of the intermediate electrode into holes opening on the foreside of the insulating board. Thus, screw fastening may be omitted to minimize the space for mounting the intermediate electrode. This will enable the entire thickness of the smoke detector to be reduced and the assembling steps to be simplified.

In addition, the support legs each have serrate edges so that they can fix and support the intermediate electrode positively in place when they are fitted in the engaging holes of the insulating board.

Furthermore, an electrode lead to be formed on a periphery of the intermediate electrode extends through the insulating board to be connected to a lead of an FET incorporated (potted) at a suitable place on the backside of the insulating board, the through hole of the insulating board for the electrode lead is fully sealed. Thus, possible penetration of moisture or corrosive gases into the circuit-accommodating portion through the through hole to corrode the circuit parts.

The present invention further features an ionization smoke detector including an insulating board provided within a cover and a circuit board disposed on a backside of the insulating board, said insulating board having an intermediate electrode with a radiation source, an intermediate electrode formed with an opening for transmitting radiation from said radiation source, and an outer electrode formed with smoke inlets on its side wall which are all mounted on said insulating board: said insulating board having an annular engaging flange portion formed integrally on a periphery of the insulating board, and said cover having an engaging groove into which said engaging flange is inserted; said engaging flange having a tip end extending towards the backside of the insulating board and directed outwardly; said engaging groove having an outer inside wall inclined so that the engaging flange inserted in the groove presses against the wall; said intermediate electrode having a plurality of support legs and at least one electrode lead formed integrally therewith; said electrode lead being inserted into a slit from a foreside of the insulating board and connected to a lead of an FET incorporated and insulatedly sealed on a backside of the insulating board; and said support legs each having serrated edges and inserted to be fixed in holes opened on the foreside of the insulating board but not through.

The electrode lead may be formed integrally with the support leg in the form of extension of the support leg.

The insulating board has openings for passing contact metal members of the outer electrode for the circuit board therethrough, said openings being formed, leaving a thin, film-like portion before the contact metal members have not been passed therethrough. In this case, possible penetration of moisture etc. through the openings for passing the contact metal members therethrough can be prevented.

The insulating board may have openings for inserting an LED on the circuit board for alarm indication therethrough. The openings are formed, leaving a thin, film-like portion before the LED has not been inserted therethrough. In this case, possible penetration of moisture etc. through the opening for passing the contact metal members of LED therethrough can be prevented.

The inner electrode may be fitted in an opening and the inner electrode may be caulked at its shoulder portion to be fixed in place after it has been fitted in the opening of the insulating board.

PREFERRED EMBODIMENT OF THE PRESENT INVENTION

Figure 1:
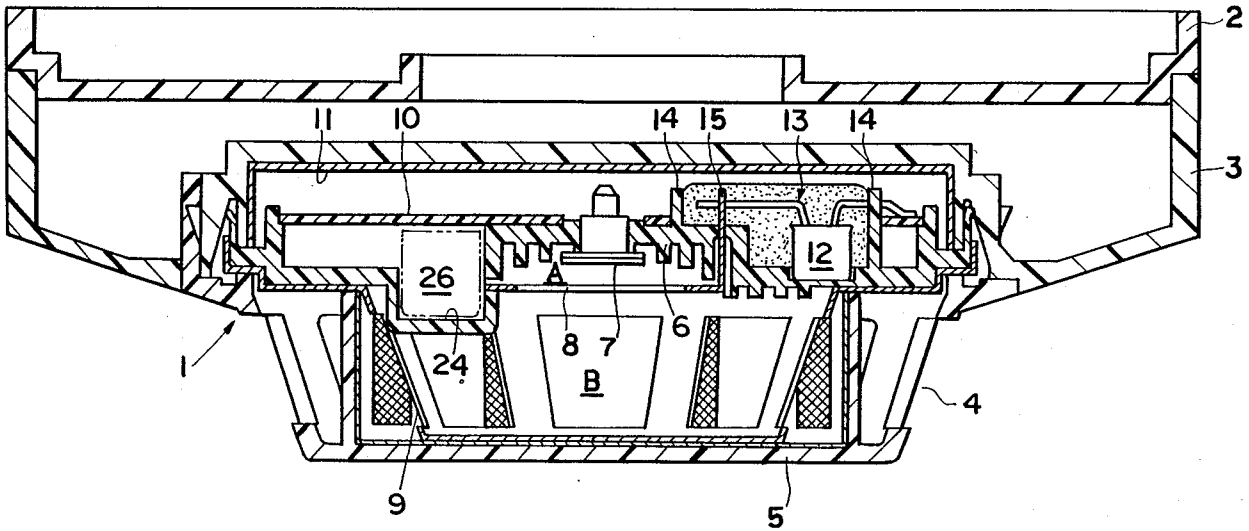
FIG. 1 is a sectional view of one form of an ionization smoke detector according to the present invention.

FIG. 1 is a vertical sectional view of one form of an ionizaiton smoke detector embodying the present invention.

In FIG. 1, 1 designates a detector body which is detachably fitted to a detector base 2 fixed on a ceiling. The detector body 1 comprises a body cover 3 adjacent to the detector base 2 and an outer cover 5 fitted to a lower side of the body cover 3 and having smoke inlets 4 on a side wall thereof.

In the detector body 1, an insulating board 6 is incorporated to partition the inside of the detector body 1 into a circuitry-encasing section and an electrode section for ionization smoke detection.

An inner electrode 7 is fitted centrally in the insulating board 6. An intermediate electrode 8 having an opening for allowing radiation from a radiation source to be transmitted therethrough is mounted, surrounding the inner electrode 7. An outer electrode 9 having smoke inlets on a side wall thereof is further provided, surrounding the intermediate electrode 8. An inner ionization chamber A is defined between the inner electrode 7 and the intermediate electrode 8 and an outer ionization chamber B which is formed to allow external smoke to enter thereinto is defined between the intermediate electrode 8 and the outer electrode 9.

An FET-accommodating portion 13 encased by a partition wall 14 is provided at an appropriate position of the backside of the insulating board 6. An FET 12 is incorporated in the FET-accommodating portion 13. A lead 15 of the intermediate electrode 8 is passed through the insulating board 6 and connected to a lead of the FET 12 incorporated in the FET-accommodating portion 13. A hot melt synthetic resin is filled to pot the FET 12 together with the FET-accommodating portion 13 accommodating the FET 12 and the intermediate electrode lead 15 connected thereto. Thus, the FET-accommodating portion 13 together with the FET 12 and the lead 15 are all potted. The lead of the FET 12 is also potted in the synthetic resin.

A capacitor-accommodating portion 24 is also formed on the backside of the insulating board 6 in the embodiment as illustrated.

The insulating board 6 further has a circuitry-accommodating portion on the backside thereof. A printed circuit board 10 is fitted closely to the backside of the insulating board 6. A capacitor 26 accommodated in the capacitor-accommodating portion 24 and the FET 12 potted in the FET-accommodating portion 13 are connected to the printed circuit board 10.

A cylindrical shield case 11 which opens downwardly is mounted at an upper portion of the circuitry-accommodating portion provided on the backside of the insulating board 6 to which the printed circuit board 10 is fitted. The reverse side, to wit, the foreside of the insulating board 6 is shielded by the outer electrode 9.

Figure 2:
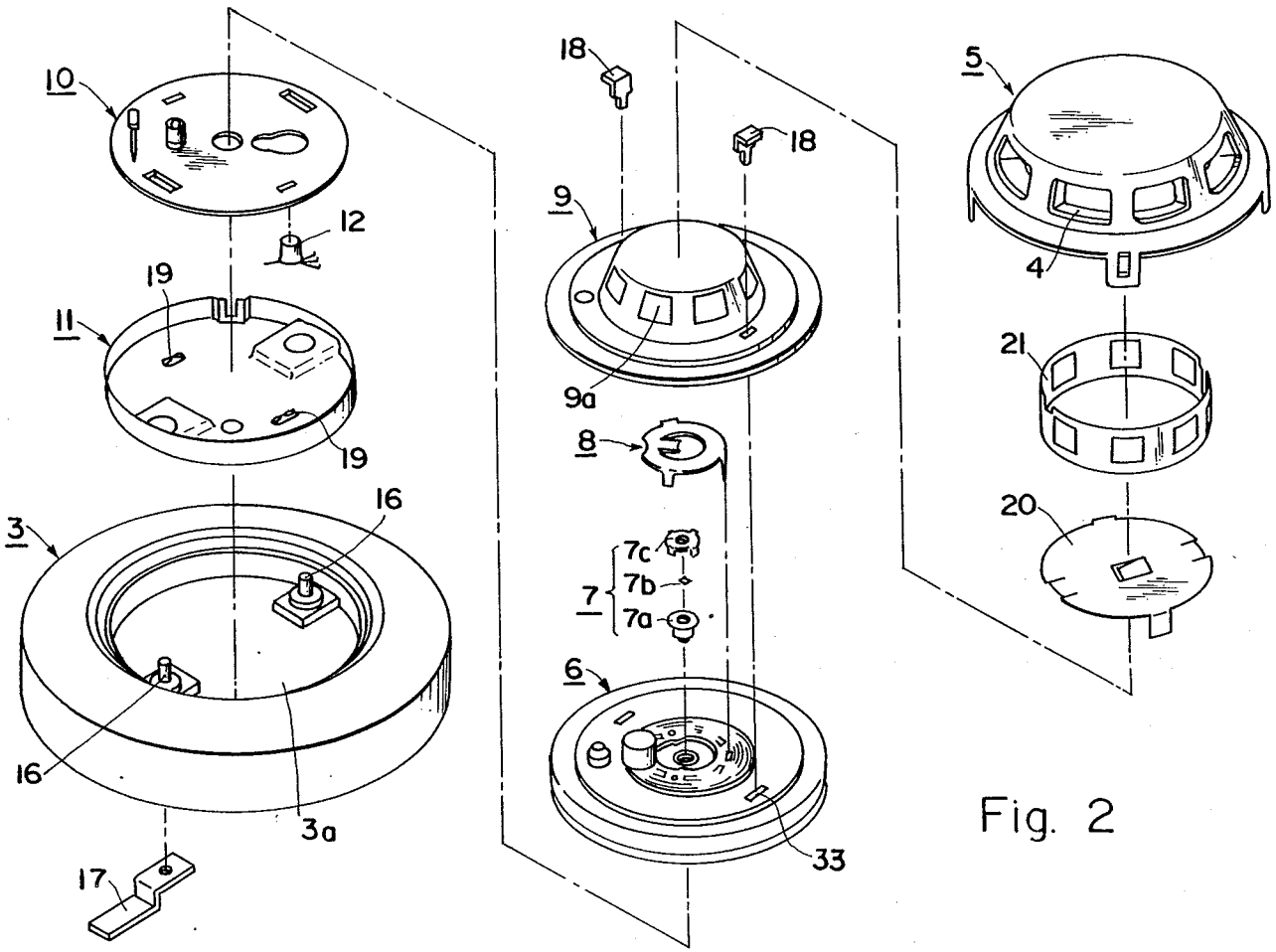
FIG. 2 is an exploded perspective view of the detector shown in FIG. 1.

FIG. 2 is an exploded perspective view of the detector body 1 shown in FIG. 1.

In FIG. 2, the body cover 3 has an inner opening 3*a* which opens downwardly (as viewed in FIG. 2). Two contact pins 16 are provided at the inner opening 3*a* for electrically connection to the printed circuit board 10. An engaging member 17 is fixed to the lower side of each of the contact pins 16 for engaging with the detector base 2.

The shield case 11 is assembled in the inner opening 3*a* of the body cover 3 and the printed circuit board 10 packaging the detector circuitry is in turn assembled therein.

Further to the printed circuit board 10, the insulating board 6 is assembled and the inner electrode 7 comprising an electrode member 7*a*, a radiation source 7*b* and an electrode cover 7*c* is fitted centrally to the insulating board 6. Around the inner electrode 7, the annular intermediate electrode 8 is mounted. Around the intermediate electrode 8, the outer electrode 9 having smoke inlets 9*a* formed on the side wall thereof is mounted.

The outer electrode 9 is fixed to the insulating board 6 by inserting contact metal members 8 through slits 33 of the insulating board 6. A tip end of each of the contact metal member 18 extends through the printed circuit board 10 to contact a contact portion 19 of the shield case 11. The contact metal member 18 is soldered at a grounding portion of the printed circuit board 10 through which the contact metal member 18 extends. Thus, the contact metal member 18 functions to fix the outer electrode 9 to the insulating board 6 and to provide electrical connection for shielding the accommodating portion of the printed circuit board 10 in combination with the shield case 11.

Further to the outer electrode 9, a bottom board 20 and the outer cover 5 having smoke inlets 4 formed on the side wall thereof are assembled. Inside of the outer cover 5, a fly-screening net 21 is provided.

Figure 4:
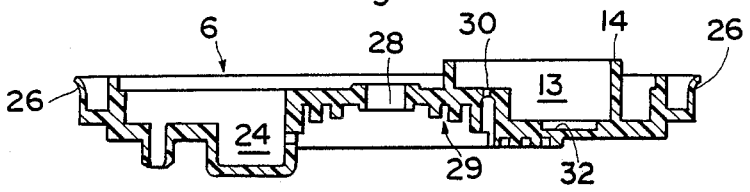
FIG. 4 is a centrally taken sectional view of the insulating board.
Figure 3:
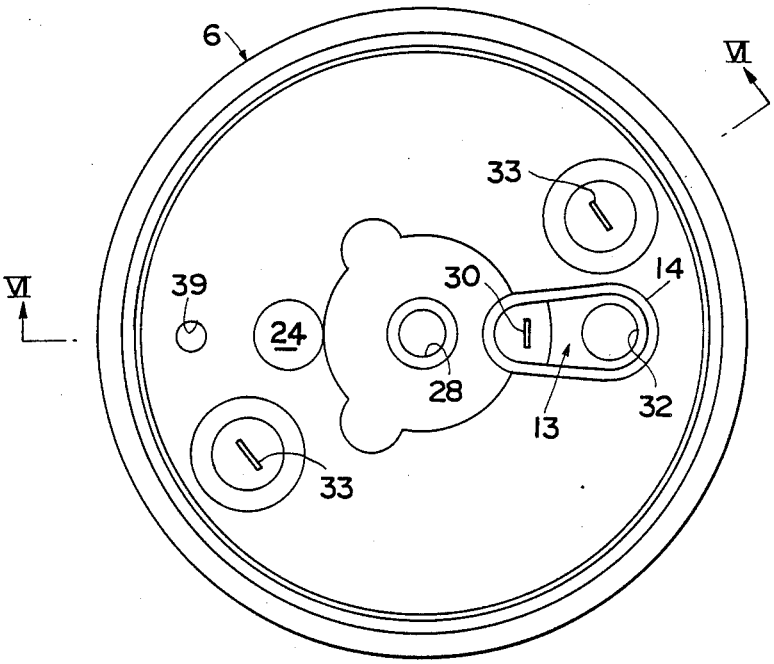
FIG. 3 is a plan view of a backside of an insulating board.
Figure 6:
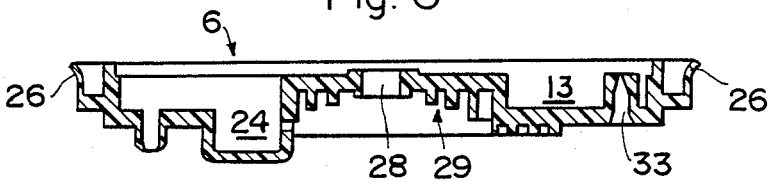
FIG. 6 is a sectional view of the insulating board taken along line VI—VI of FIG. 3.
Figure 5:
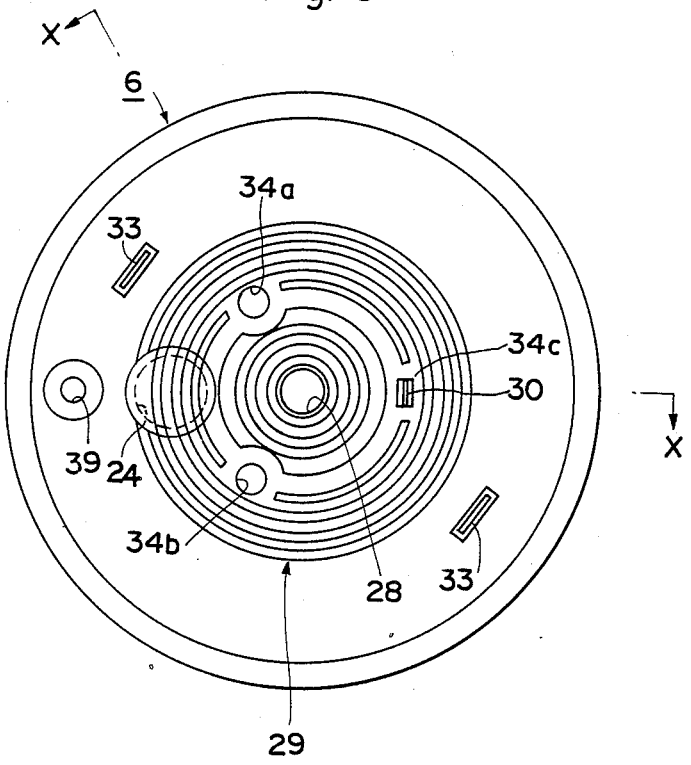
FIG. 5 is a plan view of a foreside of the insulating board.

FIGS. 3 to 6 illustrates the insulating board 6 shown in FIG. 1: FIG. 3 is a plan view of the backside of the insulating board 6, FIG. 4 is a vertical sectional view of the same taken along a line passing through a center, FIG. 5 is a plan view of the foreside of the insulating board 6; and FIG. 6 is a vertical sectional view taken along a line VI—VI of FIG. 3.

Figure 8:
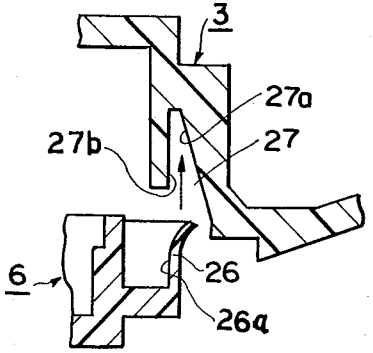
FIG. 8 is a fragmentary sectional view showing the insulating board before it is fixed.
Figure 9:
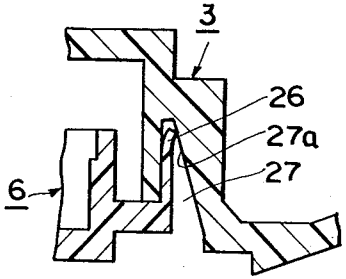
FIG. 9 is a similar fragmentary sectional view showing the insulating board after it has been fixed.

As illustrated in FIG. 4, an annular engaging flange portion 26 is integrally formed on the outer periphery of the insulating board 6. This engaging flange portion 26 has a free end which extends towards the backside of the insulating board 6 and extends outwardly. On the other hand, the body cover 3 to which the insulating board 6 is fitted has an engaging groove 27 at a position corresponding to the engaging flange portion 26 as best shown in FIGS. 1, 8 and 9. The engaging groove 27 is so formed that an outer, inner wall of the groove has an inclined face 27*a* as best seen in FIGS. 8 and 9. The largest diameter of the groove 27 is slightly smaller than the outer diameter of the engaging flange portion 26.

Figure 7:
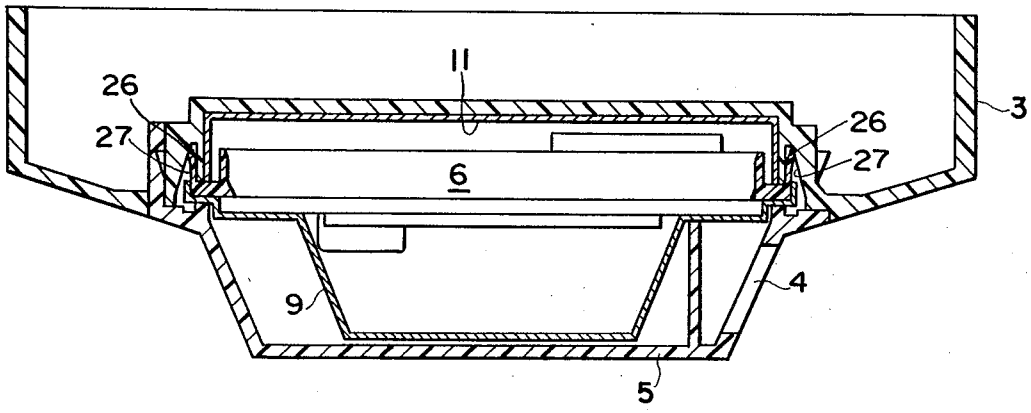
FIG. 7 is a sectional view of the ionization smoke detector with the insulating board fixed therein.

FIG. 7 shows an arrangement of the insulating board 6 in relation with the detector body 1 which comprises a body cover 3 and the outer cover 5. In FIG. 7, a part of the electrode structure is omitted.

More particularly, the insulating board 6 is assembled by inserting the annular engaging flange portion 26 formed on the outer periphery thereof into the engaging groove 27 formed in the body cover 3. Simultaneously the insulating board 6 is assembled, the shield case 11 is set in the circuitry accommodating portion. The outer cover 5 is fitted thereafter, intervening the outer electrode 9.

Before the insulating board 6 is mounted as illustrated in FIG. 8, the annular engaging flange portion 26 has a free end bent to extend outwardly. When the annular engaging flange portion 26 is pushed into the engaging groove 27 of the body cover 2 as indicated by arrow, the annular engaging flange portion 26 is pressed inwardly by the engaging groove 27. Thus, the tip end of the insulating board 6 is pressed against the outer inclined inner face of the engaging groove 27 by a reaction of the compressed annular engaging flange portion 26. As a result of this, possible penetration of moisture or corrosive gas into the circuitry-accommodating portion can be positively prevented without using a rubber packing etc.

When the annular engaging flange portion is pushed into the engaging groove, the inner face of the flange 26 is forced to press against the inner wall 27*b* of the groove to prevent penetration of the outside air.

Figure 13:
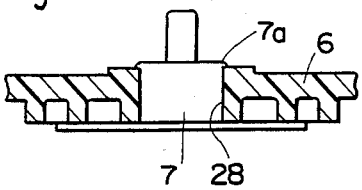
FIGS. 13 (A) and (B) are sectional views each showing an inner electrode before and after it has been fitted in an opening, respectively.
Figure 13:
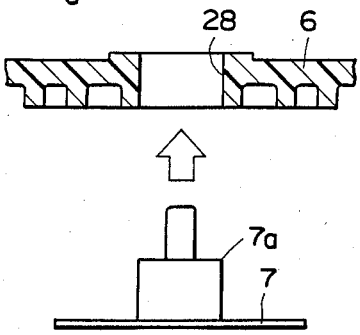

In FIG. 4, the insulating board 6 has an opening 28 at its central position thereof for mounting the inner electrode 7 thereon. When the inner electrode 7 is mounted in the opening of the insulating board 6, an edge 7*a* of the inner electrode 7 is caulked after the inner electrode 7 has been inserted through the opening 28 as illustrated in FIGS. 13 (A) and (B). Thus, the inner electrode 7 is fixed in the opening 28 of the insulating board 6. Because the inner electrode 7 is fixed by caulking, a gap between the inner electrode 7 and the opening 28 is fully sealed. As a result of this, possible penetration of moisture etc. through the gap can be prevented.

Figure 10:
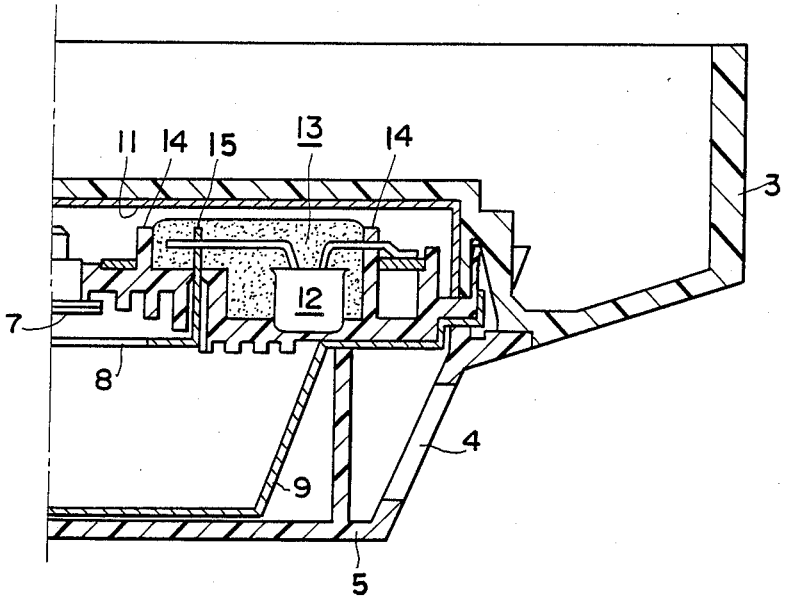
FIG. 10 is an enlarged sectional view of an FET accommodating structure.

A multi-annular groove structure 29 comprising a plurality of annular grooves is provided around the opening 28 within a space between the electrodes. A slit 30 is formed in the insulating board 6 for passing the electrode 15 of the intermediate electrode 8 as shown in FIG. 10 from a right portion (in FIG. 4) of the multi-annular groove structure 29 to the FET accommodating portion 13 encased by the partition wall 14 on the backside of the insulating board 6.

In this connection, it is to be noted that the capacitor-accommodating portion 24 is formed on the backside of the insulating board 6 on the left side of the opening 28.

Referring now to FIG. 3 which shows a plan view of the backside of the insulating board 6, the FET-accommodating portion 13 formed in an elliptical shape and encircled by the partition wall 14 on the right side of the opening 28 is disposed centrally in the insulating board 6. The FET-accommodating portion 13 has at a bottom portion thereof an FET-receiving hole 32 and the slit 30 if formed at an inner position for passing the lead 15 of the intermediate electrode 8.

The configurations of the FET-accomodating portion 13 and the capacitor accommodating portion 31 will be more apparently understood from a centrally taken sectional view of the insulating board 6 as illustrated in FIG. 4.

Figure 15:
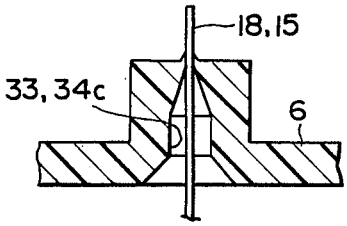
FIGS. 15 (A) and (B) are sectional views each showing a contact metal or an electrode lead before and after it has been inserted into a slit or a hole, respectively.
Figure 15:
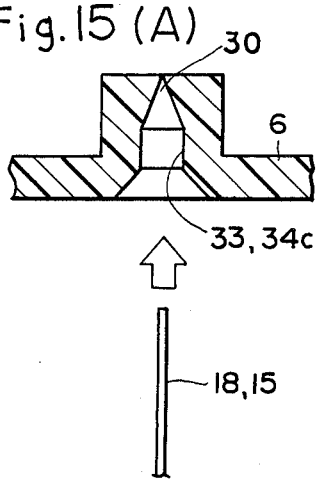

In FIG. 3 and 5, two slits 33 are formed at positions deviated from the center of the insulating board 6 for passing the contact metal members 18 for fixing the outer electrode 9 towards the backside of the insulating board 6. Each of the slits 33 is so shaped that it has an inner diameter reducing towards the top as illustrated in FIG. 6, FIG. 15(A). The slit 33 is shaped to point at the top, leaving a very thin, film-like portion at the backside of the insulating board 6. The contact metal member 18 is inserted into the slit 33, while breaking the thin, film-like portion of the slit 33 as shown in FIG. 15(B). Since the thin, film-like portion is left for the slit 33 and the contact metal member 18 is inserted breaking the thin film portion, the thin film-like portion closely contact the contact metal member 18 after the contact metal member 18 is inserted therethrough. As a result of this, possible penetration of moisture etc. through the slit 33 can be prevented.

Referring now to FIG. 5 which shows the foreside of the insulating board 6, engaging holes 34*a*, 34*b* and 34*c* are formed at positions outer than the opening 28 for mounting the intermediate electrode 8. The engaging holes 34*a*, 34*b* are engaged with support legs 24*a*, 24*b* of the intermediate electrode 8 having no electrode lead as illustrated in FIGS. 11(A, B and C). The slit 30 for passing the electrode 15 provided on a support leg 24*c* of the intermediate electrode 8 as shown in FIGS. 11(A, B and C) opens within the engaging hole 34*c*.

Figure 14:
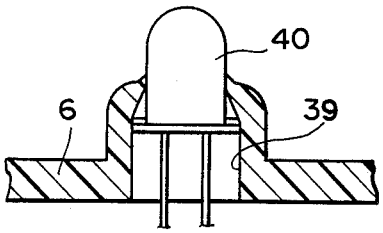
FIGS. 14 (A) and (B) are sectional views each showing an LED before and after it has been fitted through an opening, respectively.
Figure 14:
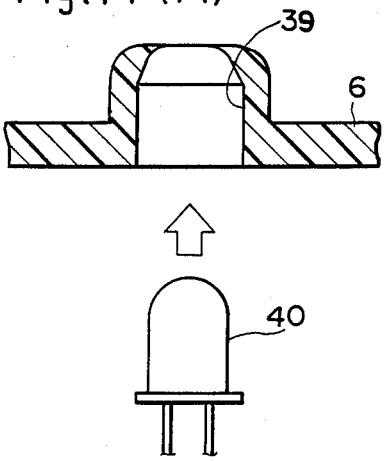

An opening 39 formed on a leftside projection corresponding to the capacitor accommodating portion 24 is used for fitting an LED 40, which is provided on the printed circuit board 10 for indication of alarm, therein. This opening 39 is formed, leaving a thin film-like portion on the foreside of the insulating board 6 as illustrated in FIG. 14(A). Thus, the diameter of the opening 39 is smaller than an outer diameter of the LED 40. With this formation, when the LED 40 is pushed into the opening 39, a peripheral portion at a forward end of the opening 39, namely the thin film-like portion of the opening 39 is urged to closely contact the LED 40 as illustrated in FIG. 14B. Thus, a gap is not formed between the opening 39 and the LED 40, which can prevent possible penetration of moisture etc. through the opening 39.

As illustrated in FIG. 11, the intermediate electrode 8 is formed in an annular shape in plan. The intermediate electrode 8 has an opening 22 for allowing radiation from the radiation source 7*b* as shown by a broken line to transmit therethrough and an electrode portion 23 formed integrally with the intermediate electrode 8 to extend towards a center of the opening 22. The electrode portion 23 is provided for compensating decrease of an ionization current in the inner ionization chamber which whould otherwise be caused by widening the irradiation range of radiation from the radiation source 7*b* for the outer ionization chamber. More particularly, since the electrode portion 23 extends to a portion where central radiation from the radiation source 7*b* is concentrated, sufficient ionization current in the inner ionization chamber can be acquired by the electrode portion 23 despite of the large opening 22.

The intermediate electrode 8 further has the support legs 24*a*, 24*b*, 24*c* formed on the periphery of the intermediate electrode 8 integrally with the electrode 8.

Figure 11A:
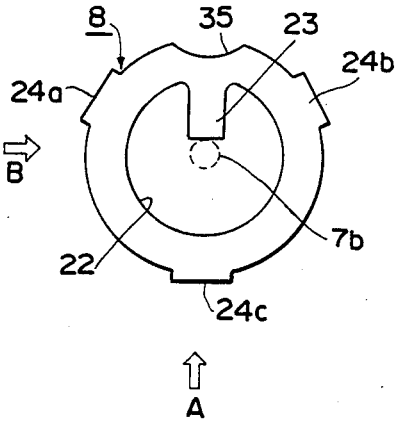
FIG. 11 (A) is a plan view of an intermediate electrode and FIGS. 11 (B) and (C) are side views taken according to arrows A and B, respectively.
Figure 11:
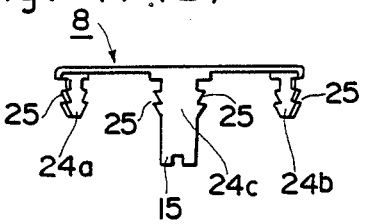
Figure 11:
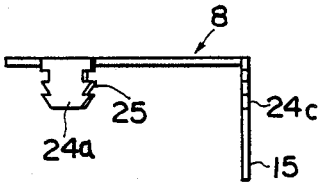

The electrode lead 15 is integrally formed with one of the support legs 24*a* to 24*c*, namely, the support leg 24*c* as illustrated in the side elevational views of FIGS. 11(B) and (C). The electrode lead 15 extends through the insulating board 6 to be connected to the lead of the FET 12 set in the FET-accommodating portion 13. The support legs 24*a* to 24*c* each have serrate side edges 25 as illustrated in FIGS. 11 (B) and (C).

Figure 12:
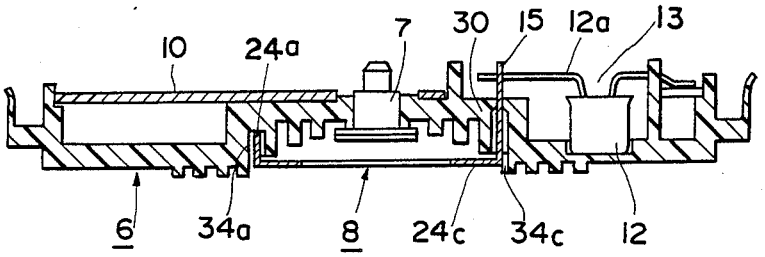
FIG. 12 is a sectional view of the ionization smoke detector with the intermediate electrode mounted thereon.
Figure 16:
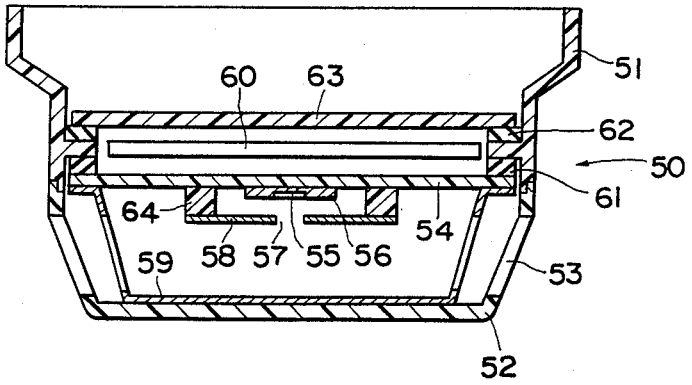
Fig. 16 (PRIOR ART)
FIG. 16 is a sectional view of a conventional ionization smoke detector.

FIG. 12 is a sectional view showing the intermediate electrode 8 shown in FIG. 11 which is now mounted on the insulating board 6 shown in FIG. 4. The insulating board 6 is shown in section taken along line X—X of FIG. 5.

In FIG. 12, the intermediate electrode 8 is engaged, at its two support legs 24*a* 24*b* formed on the periphery of the intermediate electrode 8, with the two holes 34*a*, 34*b* opening on the foreside of the insulating board 6 as shown in FIG. 5, respectively. Since the support legs 24*a*, 24*b* have serrate side edges 25, they can be fixedly held in the holes 34*a*, 34*b*, respectively, when they are fitted in the respective holes.

On the other hand, as shown in FIG. 12, the electrode lead 15 formed integrally with the support leg 24*c* of the intermediate electrode 8 is fitted in the slit 30 formed at a bottom portion of the hole 34*c* of the insulating board 6. A tip end of the electrode lead 15 is soldered to a lead 12*a* of the FET 12 accommodated in the FET-accommodating portion 13 formed on the backside of the insulating board.

Since a hot melt synthetic resin is filled over FET 12 with the electrode lead 15 of the intermediate electrode 8 soldered to the lead 12*a* of the FET 12 to be insulatingly sealed as shown in FIG. 10, the slit 30 of the insulating board 6, through which the electrode lead 15 of the intermediate electrode 8 extends, is sealed by the insulating seal of the FET-accommodating portion 13. Thus, possible penetration of moisture or corrosive gases into the circuitry accommodating portion on the backside of the insulating board 6 through the slit can be positively prevented.

Due to the insulating seal by injecting a potting material such as a hot melt synthetic resin into the FET-accommodating portion 13 after the lead has been soldered, possible electrostatic breakdown can be prevented when the FET-accommodating portion 13 is touched by hand in the assembling process.

Since the FET-accommodating portion 13 is formed on the insulating board 6 and the potting is attained in the course of the assembling on the insulating board 6, the number of manufacturing steps can be reduced as compared with the conventional process in which the potting is carried out before the assembling step.

Furthermore, according to the present invention, the mounting of the intermediate electrode 8 onto the insulating board 6 can be attained merely by fitting the support legs 24a to 24c of the intermediate electrode 8 into the holes 34a to 34c opened on the foreside of the insulating board 6, respectively. Thus, no screws are needed to mount the intermediate electrode 8 onto the insulating board 6 and the space for mounting the intermediate electrode 8 can be minimized. The mounting operation itself is easy and simple. In this connection, it is to be noted that the hole 34c into which the support leg 24c is inserted is so formed that the diameter is reduced to point, leaving a thin, film-like portion at the end of the hole, as the slit 33 into which the contact metal member 18 is inserted as shown in FIG. 15(A). Therefore, when the support leg 24c is inserted into the hole 34c, the electrode lead 15 formed integrally with the support leg 24c is inserted, piercing the thin film-like portion until it reaches to the backside of the insulating board 6. Thus, possible penetration of moisture through the hole 34c can also be prevented.

Although support leg 24c formed integrally with the electrode lead 15 of the intermediate electrode 8 has serrate edges 25 in the embodiment as illustrated in FIG. 11, the serrate edges 25 may be provided only on the support legs 24a, 24b which have not an electrode lead an inserted in the holes 34a, 34b opening at the foreside of the insulating board 6, respectively, but not provided on the support leg 24 having the electrode lead. This is because the electrode lead 15 extends from the foreside to the backside of the insulating board 6 to be fixed to the lead 12a of FET 12 by soldering and the fixation is possibly loosened by heating at the time of soldering. However, the number of the support legs is preferably increased to assure more positive fixation.

In this connection, it is to be noted that a cutout 35 formed on the periphery of the intermediate electrode 8 as shown in FIG. 11 is formed so as to be complementary with the cylindrical projection for the capacitor-accommodating portion 31. In the case where the capacitor accommodating portion 31 is provided outside of the intermediate electrode 8, the cutout 35 may be omitted.

What is claimed is:

1. A ionization smoke detector, comprising a cover, an insulating board having a backside being provided within said cover, a circuit board disposed on the backside of the insulating board, said insulating board having an inner electrode with a radiation source, an intermediate electrode formed with an opening for transmitting radiation from said radiation source, and an outer electrode formed with smoke inlets on its side wall, said inner, outer and intermediate electrodes mounted on said insulating board;

said insulating board having an annular engaging flange portion formed integrally on a periphery of the insulating board, and said cover having an engaging groove into which said engaging flange is inserted;

said engaging flange having a tip end extending towards the backside of the insulating board and directed outwardly; and said engaging groove having an outer inside wall inclined so that the engaging flange inserted into the groove presses against the wall.

2. An ionization smoke detector, comprising a cover, an insulating board provided within the cover and having a foreside and a backside, a circuit board disposed on the backside of the insulating board, said insulating board having an inner electrode with a radiation source, an intermediate electrode formed with an opening for transmitting radiation from said radiation source, and an outer electrode formed with smoke inlets located within a side wall thereof, said inner, outer and intermediate electrodes being mounted on said insulating board;

said intermediate electrode having a plurality of supported legs and at least one electrode lead formed integrally with one of said legs;

said electrode lead being inserted into a slit from the foreside of the insulating board and connected to a lead of an FET incorporated and insulatedly sealed on the backside of the insulating board; and each said support leg having serrated edges being inserted and fixed in holes provided within the foreside of the insulating board.

3. An ionization smoke detector according to claim 2, in which said electrode lead is formed integrally with the support leg in the form of extension of the support leg.

4. An ionization smoke detector according to claim 2, in which said insulating board has openings for passing contact metal members of the outer electrode for the circuit board therethrough, said openings being formed, leaving a thin, film-like portion before the contact metal members have been passed therethrough.

5. An ionization smoke detector according to claim 2, in which said insulating board has an opening for inserting a LED on the circuit board for alarm indication therethrough, said opening being formed, leaving a thin, film-like portion before the LED has been inserted therethrough.

6. An ionization smoke detector according to claim 2, in which said inner electrode has a shoulder portion and said insulating board has an opening for fitting the inner electrode, said inner electrode is caulked at said shoulder portion to be fixed in place after it has been fitted in the opening of the insulating board.

7. An ionization smoke detector, comprising a cover, an insulating board provided with the cover and having a foreside and a backside, a circuit board disposed on the backside of the insulating board, said insulating board having an inner electrode with a radiation source, an intermediate electrode formed with an opening for transmitting radiation from said radiation source, and an outer electrode formed with smoke inlets located within a side wall thereof, said inner, outer and intermediate electrodes being mounted on said insulating board;

said insulating board having an annular engaging flange portion formed integrally on a periphery of the insulating board, and said cover having an engaging groove into which said engaging flange is inserted;

said engaging flange having a tip end extending towards the backside of the insulating board and directed outwardly;

said engaging groove having an outer inside wall inclined so that the engaging flange insert into the groove presses against the wall;

said intermediate electrode having a plurality of support legs and at least one electrode lead formed integrally with one of said legs;

said electrode lead being inserted into a slit from the foreside of the insulating board and connected to a lead of an FET incorporated and insulatedly sealed on the backside of the insulating board; and holes being provided within the foreside of the insulating board, said support legs each having serrated edges for inserting and fixing within said holes.

* * * * *